US009599330B2

(12) United States Patent
Rutan

(10) Patent No.: US 9,599,330 B2
(45) Date of Patent: Mar. 21, 2017

(54) CANDLE-STABILIZING DRIP WAX COLLECTOR WITH SHELL AND REMOVABLE LINER

(71) Applicant: Bette Rutan, Ormond Beach, FL (US)

(72) Inventor: Bette Rutan, Ormond Beach, FL (US)

( * ) Notice: Subject to any disclaimer, the term of this patent is extended or adjusted under 35 U.S.C. 154(b) by 176 days.

(21) Appl. No.: 14/495,757

(22) Filed: Sep. 24, 2014

(65) Prior Publication Data

US 2015/0086932 A1 Mar. 26, 2015

Related U.S. Application Data

(60) Provisional application No. 61/882,464, filed on Sep. 25, 2013.

(51) Int. Cl.
*F23D 3/16* (2006.01)
*F21V 35/00* (2006.01)

(52) U.S. Cl.
CPC ..... *F21V 35/006* (2013.01)

(58) Field of Classification Search
USPC ..... 431/292, 291, 297
See application file for complete search history.

(56) References Cited

U.S. PATENT DOCUMENTS 441,625 A * 11/1890 Wohlmuth ..... F21V 35/00 431/297
3,726,632 A * 4/1973 Connolly ..... F21V 35/00 431/126
4,015,940 A * 4/1977 Conlon ..... B01L 9/06 211/41.2
4,439,884 A * 4/1984 Giorni ..... B08B 1/00 15/104.04
4,544,351 A * 10/1985 Marsicano ..... F21V 35/00 206/588
4,566,055 A * 1/1986 Klees ..... F21V 35/00 362/101
4,755,135 A * 7/1988 Kwok ..... F21S 13/00 431/126
5,069,617 A * 12/1991 Lin ..... G10H 1/26 431/253
5,078,945 A * 1/1992 Byron ..... C11C 5/008 264/275
5,292,245 A * 3/1994 Spoonhour ..... F21V 35/00 431/292
5,927,966 A * 7/1999 Herrin ..... F21V 35/00 431/292
5,944,320 A * 8/1999 Werner ..... F16J 15/3288 277/355
6,098,953 A * 8/2000 Machado ..... B29C 33/123 249/93

(Continued)

*Primary Examiner* — Avinash Savani
*Assistant Examiner* — George R Blum
(74) *Attorney, Agent, or Firm* — Wilson Dutra, PLLC; Camille A. Wilson

(57) ABSTRACT

As described, the present invention provides a drip wax collector device configured to collect drip wax from a burning candle. The device may comprise a shell and removable liner, wherein the shell may obscure visibility of the collected drip wax. The drip wax collector may comprise stabilizing features on one or both the shell and the removable liner, wherein the stabilizing features may secure the position of the candle and the drip wax collector within the cavity of a candlestick holder.

17 Claims, 4 Drawing Sheets

(56) References Cited

U.S. PATENT DOCUMENTS

| | | | | |
|---|---|---|---|---|
| 6,116,248 | A * | 9/2000 | Walker | A45D 29/007 132/74.5 |
| 6,220,855 | B1 * | 4/2001 | Asheim | C11C 5/023 264/278 |
| 6,314,965 | B1 * | 11/2001 | Walker | A45D 29/007 132/74.5 |
| 6,702,573 | B2 * | 3/2004 | Massey | F21V 35/00 431/296 |
| 6,857,869 | B1 * | 2/2005 | Sun | F23D 3/16 431/289 |
| 8,297,807 | B1 * | 10/2012 | Chen | F21S 6/001 362/392 |
| 2008/0216221 | A1 * | 9/2008 | Markaj | B01D 35/10 4/289 |
| 2011/0236841 | A1 * | 9/2011 | Chapman | F21V 35/003 431/297 |
| 2012/0003445 | A1 * | 1/2012 | Crain | A47J 37/0786 428/210 |

* cited by examiner

CANDLE-STABILIZING DRIP WAX COLLECTOR WITH SHELL AND REMOVABLE LINER

This application claims priority to U.S. Provisional Application 61/882,464, filed on Sep. 25, 2013, and is incorporated by reference herein.

BACKGROUND OF THE INVENTION

1. Field of the Invention

The present invention relates to a drip wax collector comprising a shell and removable liner. More particularly, the present invention relates to a drip wax collector configured to stabilize a candle within the cavity of a candlestick holder.

2. Discussion of the Related Art

Candles were historically necessary to illuminate the dark and their popularity endures despite the introduction of electricity. Today, the light of a candle may offer a softer lighting option than an electrical source, and candles are often used to transform the ambience. The drippings of hot wax from a lit candle may be damaging and unsightly. A traditional solution to collecting drip wax includes adding ledges into the design of the candlestick, which may prevent the wax from damaging a tabletop or tablecloth. However, the wax drippings are usually visible and difficult to remove. Solutions that are more recent involve cheap and disposable discs that may be slipped over the candle, which may allow for easier removal of the wax but are still unattractive.

Another issue particularly associated with tapered candles is stabilizing the candle within the candlestick holder. The candle is rarely tailored to a particular candlestick holder, and maintaining the candle in an upright position often requires patience and technique. Some individuals may drip some of the wax into the cavity of the candlestick holder prior to placing the candle, allowing the wax to establish a foundation for the candle. Often, an individual will adjust the candle throughout use, as the uneven dripping of the wax down the candle may destabilize the position of the candle within the candlestick holder.

SUMMARY OF THE INVENTION

Accordingly, there exists a need for a better wax collector, one that may solve multiple issues in a safe, convenient, and aesthetically appealing way. The present invention provides a device to collect drip wax from a burning candle, wherein the device may comprise a shell and removable liner. In some exemplary embodiments, the shell may obscure visibility of the collected drip wax. The drip wax collector may comprise stabilizing features on one or both the shell and the removable liner, wherein the stabilizing features may secure the position of the candle and the drip wax collector within the cavity of a candlestick holder.

One general aspect comprises a drip wax collector device configured to stabilize a candle, the drip wax collector including: a removable liner configured to collect drip wax from the candle. The drip wax collector device may also comprise a shell, where the shell comprises a stabilizing ring located at a base of the shell, where the stabilizing ring is configured to align the shell and the removable liner with a candle-holding cavity, a wall extending in at least a partially vertical direction from a perimeter of the base, where the wall is configured to obscure the drip wax collected in the removable liner, and a first opening on the base configured to receive the removable liner and the candle.

Implementations may comprise one or more of the following features. The drip wax collector device where the removable liner further comprises a stabilization feature configured to stabilize the candle within one or both the removable liner or the candle-holding cavity. The drip wax collector device where the stabilization feature comprises a candle-piercing mechanism. The drip wax collector device where the removable liner comprises a disposable material. The drip wax collector device where the removable liner comprises a plurality of removable liners, where the plurality of removable liners are arranged in layers. The drip wax collector device where the disposable material comprises a foil. The drip wax collector device where the removable liner comprises a reusable material. The drip wax collector device where the reusable material comprises a silicone. The drip wax collector device where the wall comprises a decorative feature. The drip wax collector device where the decorative feature comprises one or more petals of a flower, where the one or more petals are configured to form the wall.

The drip wax collector device where the shell comprises a first material and the removable liner comprises a second material. The drip wax collector device where the removable liner further comprises a fitting mechanism configured to stabilize the removable liner within the candle-holding cavity. The drip wax collector device where the fitting mechanism comprises a texturing on an exterior of the removable liner. The drip wax collector device where the texturing comprises a series of flexible protrusions. The drip wax collector device where the wall comprises a metal. The drip wax collector device where the wall comprises a formable polymer. The drip wax collector device where the wall comprises an inner layer and an outer layer, where the outer layer comprises a heat-resistant material. The drip wax collector device where the outer layer comprises a porcelain. The drip wax collector device where the stabilizing ring comprises a slip-resistant material. The drip wax collector device where the stabilizing ring comprises a rubber.

BRIEF DESCRIPTION OF THE DRAWINGS

The foregoing and other features and advantages of the invention will be apparent from the following, more particular description of preferred embodiments of the invention, as illustrated in the accompanying drawings.

DETAILED DESCRIPTION OF THE INVENTION

Figure 1:
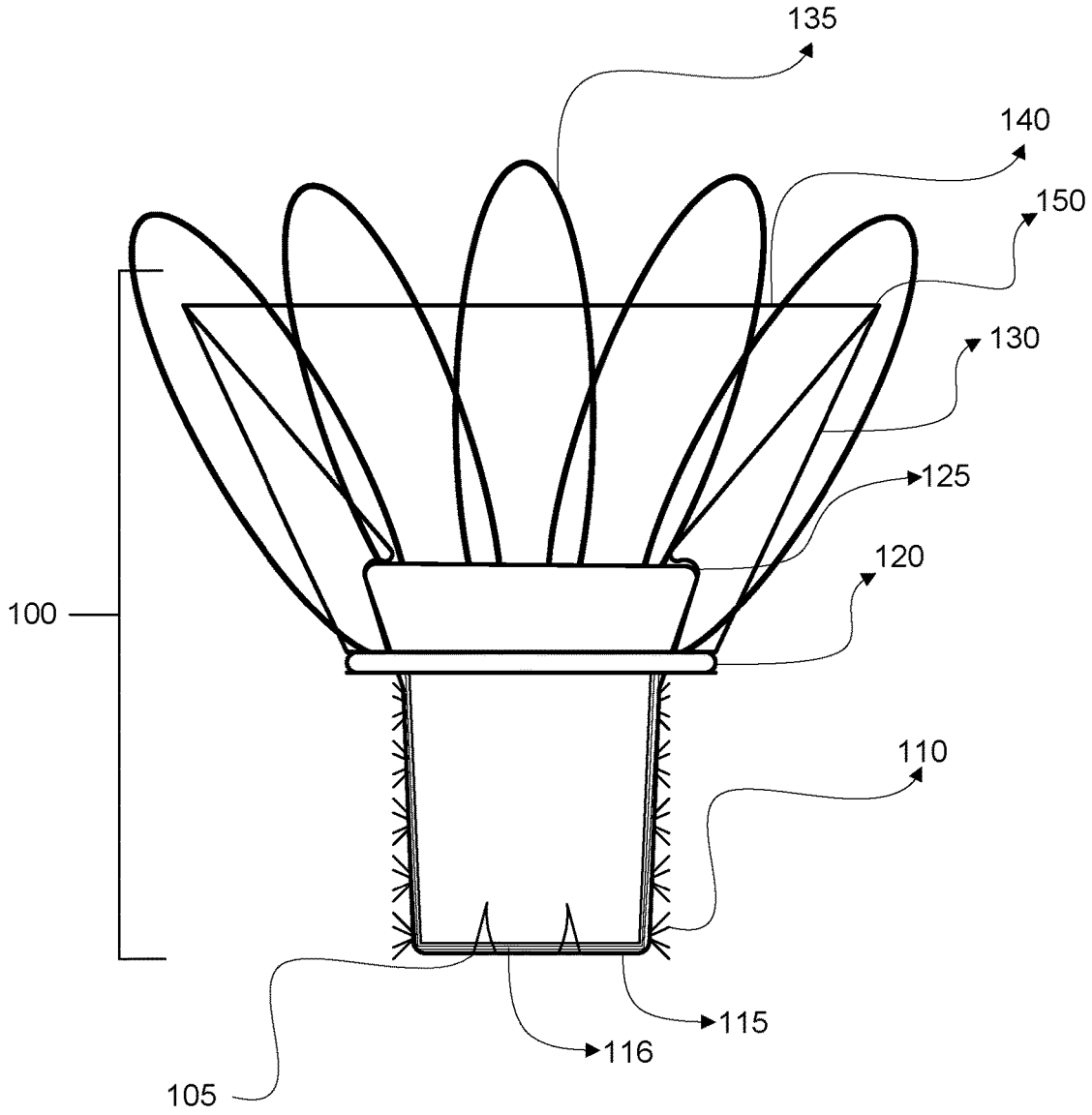
FIG. 1 illustrates an exemplary embodiment of an assembled drip wax collector with a shell and removable liner, wherein the drip wax collector may be capable of stabilizing a candle.

Referring now to FIG. 1, an exemplary embodiment of an assembled drip wax collector 100 with a shell 150 and removable liner 115, wherein the removable liner 115 comprises stabilization features 110, 105, is illustrated. In some exemplary embodiments, the shell 150 may comprise a wall 130 capable of limiting the visibility of collected candle wax. The wall 130 may comprise the borders of the receiving portion 140, which may comprise an opening capable of receiving the removable liner 115 and a candle. The wall 130 may be sloped to guide the removable liner 115 to the center of the shell 150.

In such exemplary embodiments, the wall 130 may additionally comprise a decorative feature 135. For example, the wall 130 may be designed to have the appearance of flower petals. Accordingly, a candle placed through the receiving portion 140 of the drip wax collector may appear to be held by a flower, such as a lily or a tulip.

In some aspects, the wall 130 may comprise a formable polymer, such as a silicone or acrylic. In some embodiments, the wall 130 may comprise a metal, such as, for example, silver, aluminum, iron, or stainless steel. In some embodiments, the wall may comprise a formable material that may be coated in a heat-resistant layer, such as porcelain. In some implementations, the wall 130 may be colored, wherein the coloration may be added through painting, tinting, or dyeing, for example.

In some exemplary embodiments, the shell 150 may further comprise a stabilizing ring 120, which may stabilize the contact area between the shell 150 and the candlestick. In some such embodiments, the stabilizing ring 120 may comprise a more pliable material than other portions of the shell 150. For example, the stabilizing ring 120 may comprise a rubber or plastic that may displace the weight differences that may be caused by uneven contact between the surface of the candlestick holder and the stabilizing ring 120. The stabilizing ring 120 may also reduce slippage between the shell 150 and the candlestick holder.

In still further exemplary embodiments, the shell 150 may comprise a centering or locking mechanism 125. The locking mechanism 125 may secure the position of the removable liner 115 within the drip wax collector 100. By securing the position of the removable liner 115, the locking mechanism 125 may also stabilize the position of the shell 150 relative to the candlestick holder.

In some exemplary embodiments, the removable liner 115 may comprise a concave shape that may fit within a cavity of a candlestick holder. In such examples, the removable liner 115 may cover most or all the surface of the cavity, limiting or preventing contact between the candlestick holder and wax drippings. In exemplary embodiments, the removable liner 115 may comprise a heat resistant material capable of withstanding the temperatures associated with a burning candle and melted candle wax, which may range from 30 to 70 degrees Celsius, for example.

In some embodiments, the removable liner 115 may comprise a heat-resistant disposable material, wherein the removable liner 115 may be discarded after use. A disposable removable liner 115 may be used for multiple uses or for a single use. In some embodiments, the removable liner 115 may comprise multiple layers 116 of the disposable material, wherein a layer may be removed after each use. For example, the disposable removable liner 115 may comprise a paper, a foil, a fabric, or any other formable material.

Alternatively, the removable liner 115 may comprise a reusable material, wherein the collected wax drippings may be washed or scraped from the reusable material. For example, the removable liner 115 may comprise a formable polymer, such as a pliable and slick rubber or plastic or silicone, wherein the removable liner 115 may be flipped inside out allowing for easier wax removal. In such examples, the wax may not adhere to the reusable material, which may allow the wax to be peeled off.

Figures 4A, 4B, 4C:
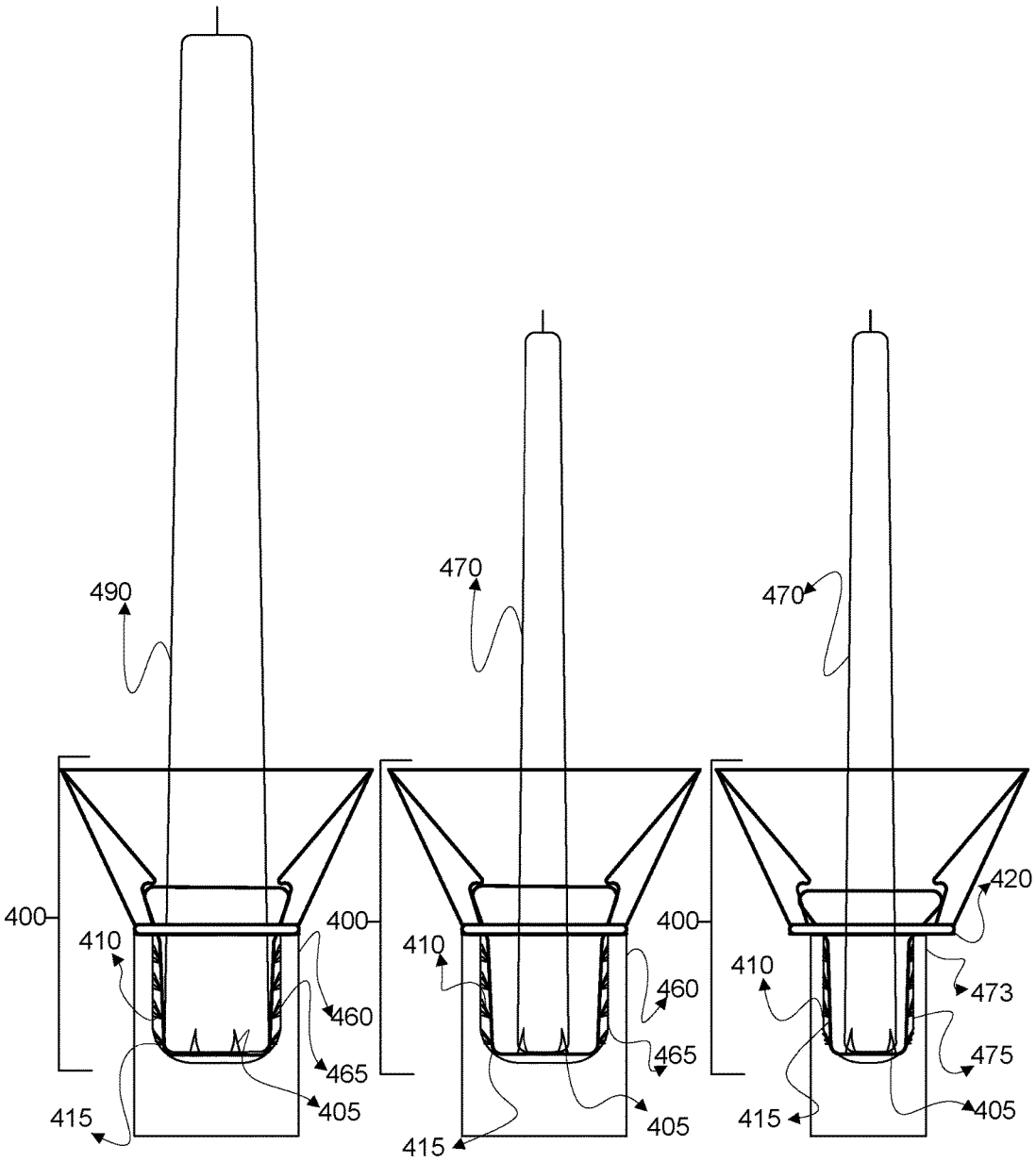
FIGS. 4A-4C illustrate exemplary embodiments of a drip wax collector placed in a candlestick holder, wherein the drip wax collector may accommodate candles within a range of heights and diameters and may fit in candlestick holders within a range of diameters.

In some exemplary embodiments, the removable liner 115 may comprise a candle stabilizer feature 105, which may center and secure the position of a candle within the removable liner 115. As an illustrative example, the candle stabilizer feature 105 may comprise a spike or other candle-piercing mechanism that may pierce the candle, such as at the bottom or the sides. The spikes may be arranged to accommodate a range of diameters, for example, as illustrated in FIGS. 4A-4C. As another example, the sides of the removable liner 115 may comprise downward facing protrusions, wherein a candle may be placed in the removable liner and a vertical pull may allow the protrusions to pierce the candle.

In exemplary embodiments, the removable liner 115 may comprise a fitting feature 110, which may secure the removable liner 115 within a candlestick holder. The fitting feature 110 may be located on the portion of the removable liner 115 that may be in contact with the candlestick holder. In some examples, the fitting feature 110 may comprise a textured material that may increase the friction between the exterior surface of the removable liner 115 and the candlestick holder. As an illustrative example, the fitting feature 110 may comprise pliable hairs, which may bend when placed in contact with the candlestick holder, such as illustrated in FIG. 2B.

In other embodiments, the stabilizer feature 105 and the fitting feature 110 may be integrated with the material of the removable liner 115. For example, the removable liner 115 may comprise a rigid but foldable or bendable material, such as aluminum foil. In such examples, the removable liner 115 may comprise a general concave shape that may be further shaped to fit the base of a candle and the cavity of a candlestick holder.

Figure 2A:
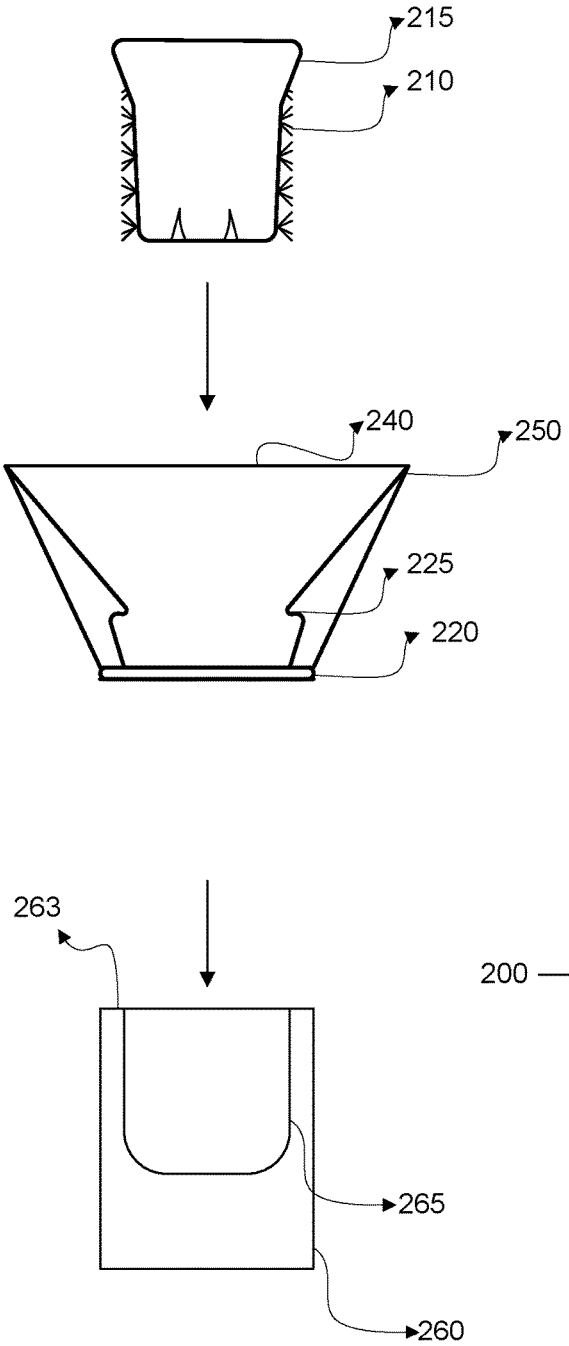
FIG. 2A illustrates exemplary process steps for assembling the drip collector and placing the drip collector in a candlestick holder.
Figure 2B:
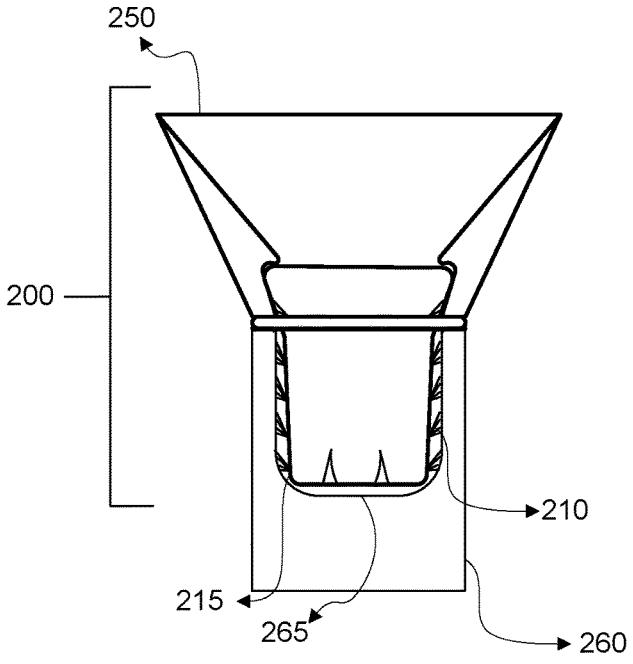
FIG. 2B illustrates an exemplary embodiment of an assembled drip wax collector placed in a candlestick holder.

Referring now to FIG. 2A, exemplary process steps for assembling the shell 250 and removable liner 215, and placing the drip collector 215, 250 in a cavity 265 of a candlestick holder 260 are illustrated. In some exemplary embodiments, the removable liner 215 may be placed through the receiving portion 240 of the shell 250 and secured in placed by the locking feature 225 of the shell 250. The removable liner 215 may be placed within the cavity 265 of the candlestick holder 260, and the stabilizing ring 220 of the shell 250 may be placed in contact with the rim 263 of the candlestick holder 260.

In some embodiments, the order of placement may be varied. For example, the removable liner 215 may be placed in the shell 250 prior to placement in the cavity 265 or the reverse may occur. Similarly, the shell 250 may be placed on the rim 263 of the candlestick holder 260 prior to receiving the removable liner 215.

Referring now to FIG. 2B, an exemplary embodiment of an assembled drip wax collector 200 placed in a candlestick holder 260 is illustrated. In some exemplary embodiments, the fitting feature 210 may be in contact with the walls of the cavity 265 of the candlestick holder 260. As an illustrative example, the fitting feature 210 may comprise pliable hairs that may shift when placed in contact with the walls of the cavity 265. The directional shift of the hairs may secure the position of the removable liner 215 within the cavity 265. In some exemplary embodiments, the fitting feature 210 may allow a removable liner 215 to fit a range of candlestick 260 cavity 265 sizes, such as illustrated in FIGS. 4B and 4C.

Figure 3A:
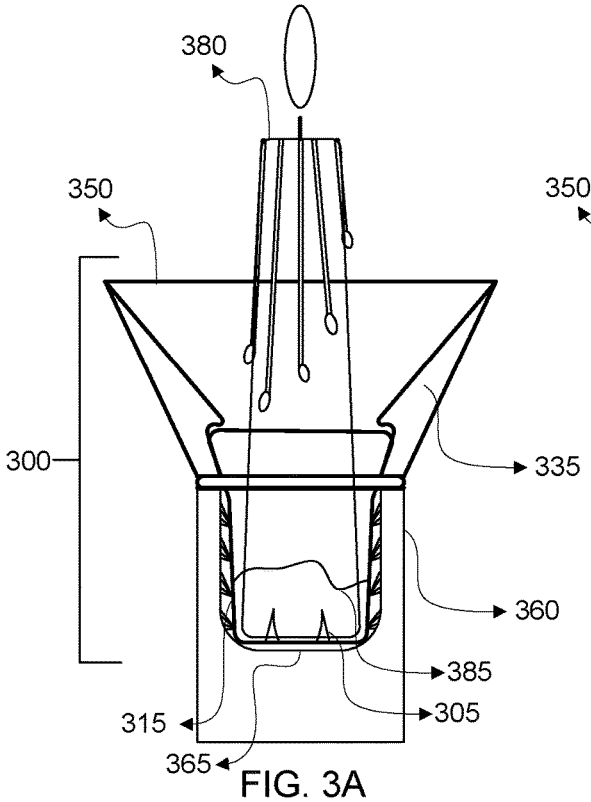
FIG. 3A illustrates an exemplary embodiment of an assembled drip wax collector placed in a candlestick holder, wherein the drip wax collector may be collecting wax drippings from a lit candle.

Referring now to FIG. 3A, an exemplary embodiment of an assembled drip wax collector 300 placed in a candlestick holder 360, wherein the drip wax collector 300 may be collecting wax drippings 385 from a lit candle 380, is illustrated. In some exemplary embodiments, the candle 380 may be secured in place by the stabilizing feature 305 on the removable liner 315. The position of the candle 380 within the removable liner 315 may allow the wax drippings 385 to pool within the removable liner 315, limiting or preventing contact with the surfaces of the shell 350 and the cavity 365 of the candlestick holder 360. In some embodiments, the walls 335 may be angled away from the candle 380 to further limit wax from dripping onto the shell 350. In some exemplary embodiments, the walls 335 of the shell 350 may extend above the removable liner 315 obscuring the collection of wax drippings 385.

Figure 3B:
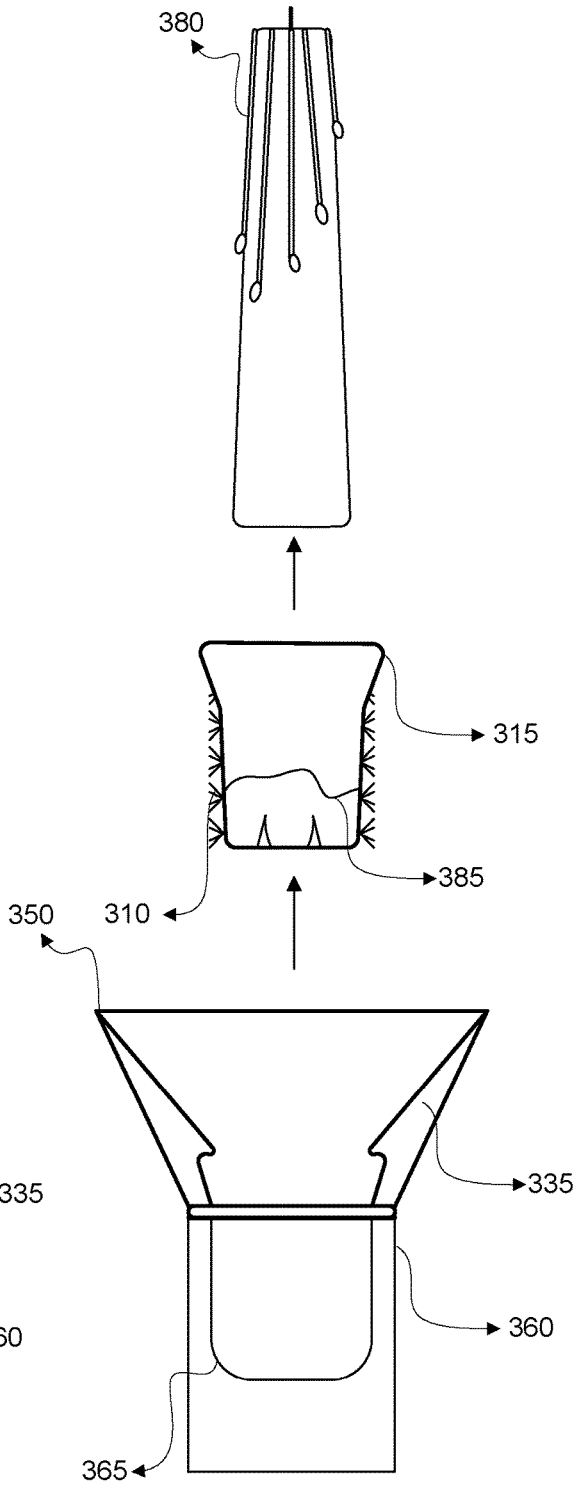
FIG. 3B illustrates exemplary process steps for removing a previously lit candle and the removable liner from the drip wax collector and candlestick holder.

Referring now to FIG. 3B, exemplary process steps for removing a previously lit candle 380 and the removable liner 315 from the shell 350 and cavity 365 of the candlestick holder 360 are illustrated. In some exemplary embodiments, a previously lit candle 380 may have dripped wax 385 into the removable liner 315. The candle 380 may be removed from the candlestick holder 360 and the removable liner 315, leaving the wax drippings 385 in the removable liner 315. The removable liner 315 may contain the wax drippings 385, limiting wax buildup on the surfaces on the walls 335 of the shell 350 and the cavity 365 of the candlestick holder 360.

In some exemplary embodiments, such as described in relation to FIG. 1, the wax drippings 385 may be cleaned out of the removable liner 315, which may allow for multiple uses of the removable liner 315. In some aspects, the removable liner 315 and wax drippings 385 may be discarded, and a new removable liner may be placed in the cavity 365 of the candlestick holder 360. In embodiments where the removable liner 315 may be reusable, the fitting feature 310 may resume a neutral or reformable shape. Such attribute may allow for subsequent uses in the same or different candlestick holder 360 without significant loss of fitting capabilities.

Referring now to FIGS. 4A-4C, exemplary embodiments of a drip wax collector 400 placed in a candlestick holder 460, 473, wherein the drip wax collector 400 may accommodate candles 470, 490 within a range of heights and diameters and may fit in candlestick holders 460, 473 within a range of cavity sizes, are illustrated. Referring to FIG. 4A, in some exemplary embodiments, the removable liner 415 of a drip wax collector 400 may accommodate a candle 490 with a larger diameter. Referring to FIG. 4B, in some exemplary embodiments, the removable liner 415 of the drip wax collector 400 may accommodate and stabilize a candle 470 with a smaller diameter in a candlestick holder 460 with a larger cavity 465.

Referring to FIG. 4C, in some exemplary embodiments, the removable liner 415 may fit in a candlestick holder 473 with a smaller cavity 475 and may accommodate a candle 470 with a smaller diameter. In FIGS. 4A-4C, the stabilizing features 405 of the removable liner 415 may secure the positions of a candle 470, 490 of various sizes. Similarly, the fitting features 410, 405 may secure the position of the removable liner 415 within various sizes of cavities 465, 475. In some exemplary embodiments, the stabilizing ring 420 may be larger than the candlestick holder 460, wherein a portion of the stabilizing ring 420 may hang off the edge of the candlestick holder 460.

Although shown and described in what is believed to be the most practical and preferred embodiments, it may be apparent that departures from specific designs and methods described and shown will suggest themselves to those skilled in the art and may be used without departing from the spirit and scope of the invention. The present invention is not restricted to the particular constructions described and illustrated, but should be constructed to cohere with all modifications that may fall within the scope of the appended claims.

What is claimed is:

1. A drip wax collector device configured to stabilize a candle within a candle-holding cavity of a candlestick holder, the drip wax collector comprising:

a removable liner comprising a textured fitting mechanism, wherein the textured fitting mechanism comprises a series of flexible protrusions, said flexible protrusions comprising pliable hairs extending radially outward, configured to stabilize the removable liner within the candle-holding cavity, wherein the removable liner is configured to collect drip wax from the candle, and wherein the removable liner fits within the candle-holding cavity; and a shell, wherein the shell comprises:

a stabilizing ring located at a base of the shell, wherein the stabilizing ring is configured to align the shell and the removable liner with the candle-holding cavity, a wall extending in at least a partially vertical direction from a perimeter of the base, wherein the wall comprises a decorative feature of one or more petals or leaves of a flower and is configured to obscure the drip wax collected in the removable liner and to add the decorative feature to the candle-stick holder, a locking mechanism, wherein the locking mechanism is configured to secure the removable liner within the shell; and a first opening on the base configured to receive the removable liner and the candle.

2. The drip wax collector device of claim 1, wherein the removable liner further comprises a stabilization feature configured to stabilize the candle within one or both the removable liner or the candle-holding cavity.

3. The drip wax collector device of claim 2, wherein the stabilization feature comprises a rigid material with one or more piercing tips.

4. The drip wax collector device of claim 1, wherein the removable liner comprises a disposable material.

5. The drip wax collector device of claim 4, wherein the disposable material comprises a foil.

6. The drip wax collector device of claim 1, wherein the removable liner comprises a reusable material.

7. The drip wax collector device of claim 6, wherein the reusable material comprises a silicone.

8. The drip wax collector device of claim 1, wherein the shell comprises a first material and the removable liner comprises a second material.

9. The drip wax collector device of claim 1, wherein the removable liner comprises a plurality of removable liners, wherein the plurality of removable liners are arranged in layers.

10. The drip wax collector device of claim 1, wherein the wall comprises a metal.

11. The drip wax collector device of claim 1, wherein the wall comprises a formable polymer.

12. The drip wax collector device of claim 1, wherein the wall further comprises a coating, wherein the comprises a heat-resistant material.

13. The drip wax collector device of claim 12, wherein the coating comprises a porcelain.

14. The drip wax collector device of claim 1, wherein the stabilizing ring comprises a slip-resistant material.

15. The drip wax collector device of claim 14, wherein the stabilizing ring comprises a rubber.

16. The drip wax collector device of claim 4, wherein the disposable material comprises a paper.

17. The drip wax collector device of claim 1, wherein the removable liner comprises a heat-resistant material.

* * * * *